US005381765A

United States Patent [19]

Rhodes

[11] Patent Number: 5,381,765

[45] Date of Patent: Jan. 17, 1995

[54] VALVE SPRING RETAINER

[75] Inventor: Myron G. Rhodes, Hartland, Wis.

[73] Assignee: Charter Manufacturing Company, Inc., Milwaukee, Wis.

[21] Appl. No.: 259,646

[22] Filed: Jun. 14, 1994

Related U.S. Application Data

[63] Continuation-in-part of Ser. No. 986,218, Dec. 7, 1992, Pat. No. 5,343,835.

[51] Int. Cl.[6] ..... F01L 3/10

[52] U.S. Cl. ..... 123/90.67; 123/188.13; 251/337

[58] Field of Search ..... 123/90.67, 90.65, 188.13; 251/337

[56] References Cited

U.S. PATENT DOCUMENTS

| | | | |
|---|---|---|---|
| 1,327,539 | 1/1920 | Finney | 251/337 |
| 1,554,227 | 9/1925 | Nickol | 251/337 |
| 1,861,885 | 6/1932 | Sims | 251/337 |
| 1,862,283 | 6/1932 | Schoetzow | 251/337 |
| 1,930,894 | 10/1933 | Gorman | 251/337 |
| 2,065,794 | 12/1936 | Colwell | 251/144 |
| 2,682,387 | 6/1954 | Gaddoni | 251/337 |
| 2,844,134 | 7/1958 | Sietman | 123/90.67 |
| 3,002,507 | 10/1961 | Bensinger et al. | 123/90 |
| 3,612,016 | 10/1971 | Jelen | 123/90.67 |
| 3,890,943 | 6/1975 | Schünlau et al. | 123/90.28 |
| 4,590,900 | 5/1986 | Hayashi | 123/90.67 |
| 4,597,408 | 7/1986 | Canter | 123/90.67 |
| 4,879,978 | 11/1989 | Pierce | 123/90.67 |
| 4,993,376 | 2/1991 | Fukutome et al. | 123/90.67 |
| 5,143,351 | 9/1992 | Pierce | 123/90.67 |
| 5,275,376 | 1/1994 | Rich | 251/337 |

*Primary Examiner*—E. Rollins Cross
*Assistant Examiner*—Weilun Lo
*Attorney, Agent, or Firm*—Quarles & Brady

[57] ABSTRACT

A keyless valve spring retainer for an internal combustion engine. The valve spring retainer has a high load strength yet can be easily assembled or unassembled on a valve stem. It includes a curved arm portion which permits the spring retainer to be located as close to the valve stem as possible yet long enough so as to be bendable for assembly or unassembly. The valve spring retainer in one embodiment clamps on the valve stem thus inhibiting rotation of the valve stem. In another embodiment, the valve spring retainer is not clamped thereon to allow rotation of the valve stem. It is adaptable to being used with a support plate for increased loading as well as externally or internally of a valve spring.

4 Claims, 3 Drawing Sheets

VALVE SPRING RETAINER

CROSSREFERENCE TO RELATED APPLICATION

This is a continuation-in-part of application Ser. No. 07/986,218 filed Dec. 7, 1992 now U.S. Pat. No. 5,343,835.

BACKGROUND OF THE INVENTION

This invention relates to a valve spring retaining device for an internal combustion engine. More particularly, it relates to a keyless valve spring retaining device which can withstand large load forces yet can be easily assembled or unassembled on a valve stem.

Keyless valve spring retainers are known in the prior art. In U.S. Pat. No. 4,879,978 a self-locking valve spring retainer is described which is fabricated from a plastic material. In U.S. Pat. No. 3,612,016 a valve spring retainer is shown which has resilient gripping portions for engaging an annular groove of a valve stem. These gripping portions extend upwardly from an indentation in the valve spring retainer. In U.S. Pat. No. 4,590,900, a divided valve spring retainer is described.

The prior art does not provide a keyless valve spring retainer which can withstand large spring forces and tensions during operation yet can be easily assembled and unassembled with much lower forces. Neither does the prior art provide a keyless valve spring retainer which can be manufactured without extensive or complex special tooling and can be employed with a standard valve stem.

It is an advantage of the present invention to provide a valve spring retainer for an internal combustion engine wherein the retainer is of a keyless construction eliminating the need for valve keys.

It is another advantage of the present invention to provide a valve spring retainer of the foregoing type which has high load strength yet can be easily assembled and unassembled onto a valve stem.

It is yet another advantage of the present invention to provide a valve spring retainer of the foregoing type which can be manufactured at lower relative cost and reduced weight.

It is still another advantage of the present invention to provide a valve spring retainer of the foregoing type which can be employed in conjunction with a support plate for increased load requirements.

It is yet another advantage of the present invention to provide a valve spring retainer which is adaptable to multiple applications with respect to spring engagement and can permit or inhibit rotation of the valve stem.

SUMMARY OF THE INVENTION

The foregoing advantages are accomplished by the present valve spring retainer for a valve of an internal combustion engine which includes a valve stem and a spring support member surrounding the valve stem and adapted to be positioned on a rigid support surface. A spring retainer member is connected to the valve stem and spaced from the spring support member. The spring retainer member has a spring retaining portion and a curved arm portion. The curved arm portion extends between the spring retaining portion and the connection to the valve stem with the curved arm portion including a connecting portion axially aligned with the valve stem. A spring member is biased between the spring support member and the spring retainer member.

In one aspect of the invention, the valve stem has a groove and an end portion of the curved arm portion of the spring retainer member which is positioned in the groove.

In a preferred manner, the curved arm portion of the spring retainer member has a configuration of a cone with a curved surface and having a circular cross sectional area larger at the base than at the top.

In another preferred manner, the spring retaining portion of the spring retainer member includes four equally spaced openings and four equally spaced grooves inside the curved arm portion with the curved arm portion initially formed in a unitary manner but separated into discrete segments.

In yet another preferred manner, the spring retainer is adapted to fit outside or inside the valve spring.

in another aspect of the invention, a support plate is positioned between the spring and the spring retaining portion of the spring retainer member.

In still another aspect of the invention, there is provided a valve spring retainer member for use with a valve stem of an internal combustion engine wherein the valve spring retainer member is adapted to be connected to a valve stem. The spring retainer member has a spring retaining portion and a curved arm portion extending between the spring retaining portion and the connection to the valve stem. The curved arm portion includes a connecting portion axially aligned with the valve stem.

In one embodiment, the spring retainer portion is located between the connection of the spring retainer member to the valve stem and the spring support member, and in another embodiment, it is located at a height approximately the same as the groove in the valve stem.

BRIEF DESCRIPTION OF THE DRAWINGS

A better understanding of the present valve spring retainer for an internal combustion engine will be accomplished by reference to the drawings wherein.

DESCRIPTION OF THE PREFERRED EMBODIMENTS

Figure 1:
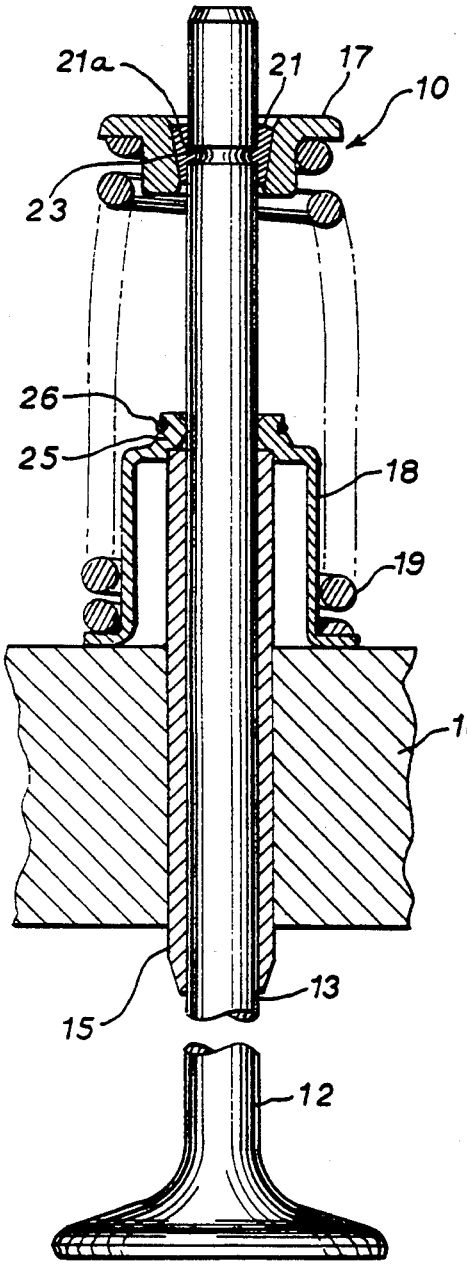
FIG 1 PRIOR ART
FIG. 1 is a view in vertical section illustrating a valve spring retainer assembly of the prior art.

FIG. 1 represents a prior art valve spring retainer assembly generally 10 which is utilized in conjunction with a valve 12 having the usual stem 13. The stem 13 is positioned for reciprocal movement through a cylinder head 16 on which is seated a spring support 18 and includes the retaining portion 25 which is clamped by the clamping ring 26. A spring extends between support 18 and spring retainer member 17 which is connected to valve stem 13 by means of the keys 21 having a flange 21*a* for engagement in an annular groove 23. This retainer assembly provides a biasing force by the spring 19 which will bias the valve 12 against a valve seat (not shown).

Figure 5:
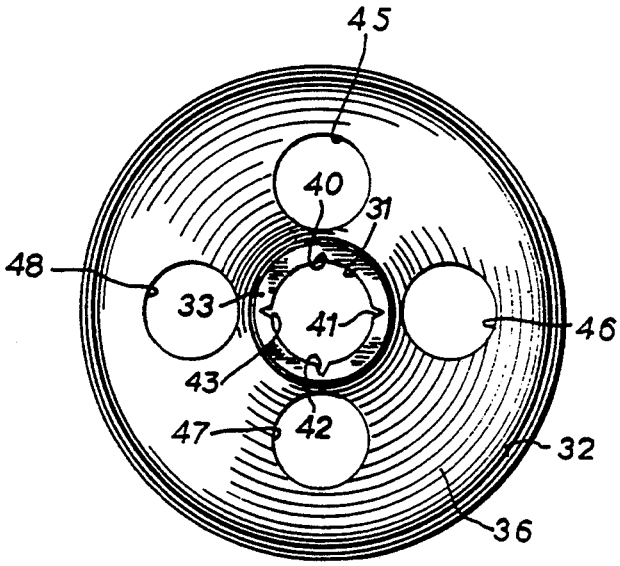
FIG. 5 is a top plan view of the valve spring retainer member.
Figure 4:
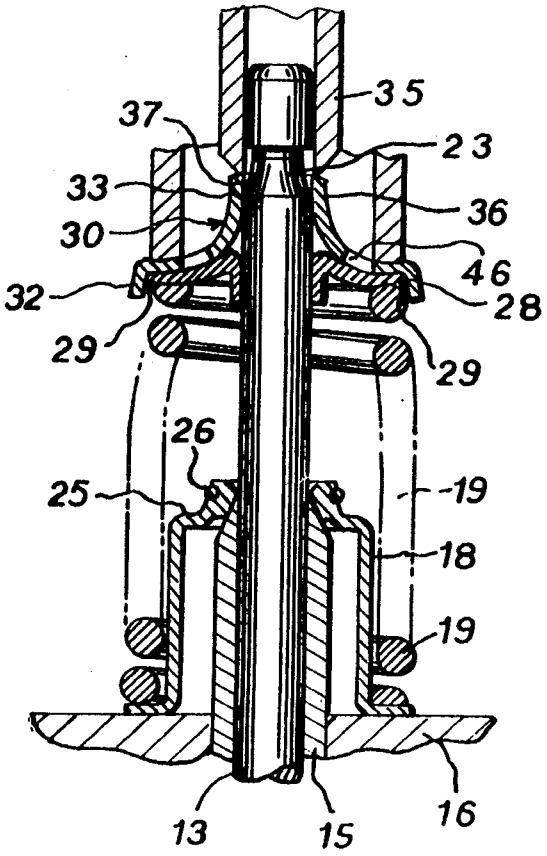
FIGS. 3 and 4 are views similar to FIG. 2 showing the assembly and unassembly of the valve spring retainer member, respectively.
Figure 2:
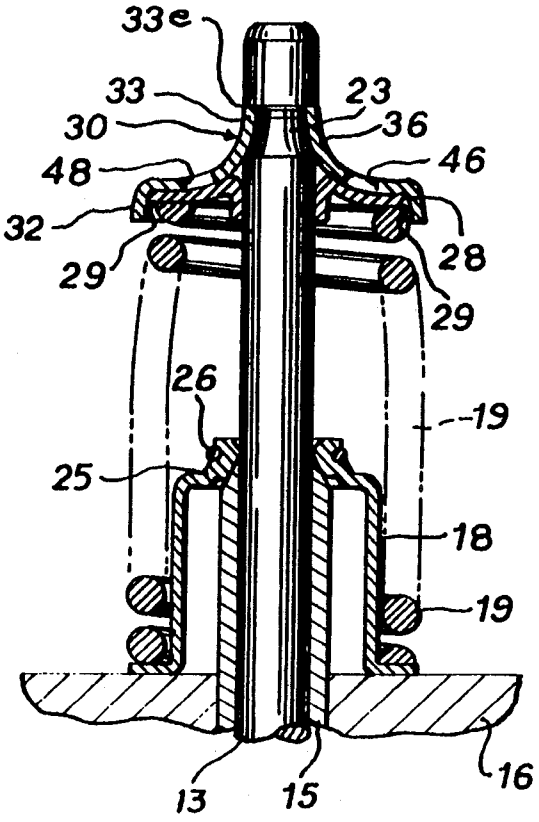
FIG. 2 is a view in vertical section illustrating the valve spring retainer assembly of this invention.
Figure 3:
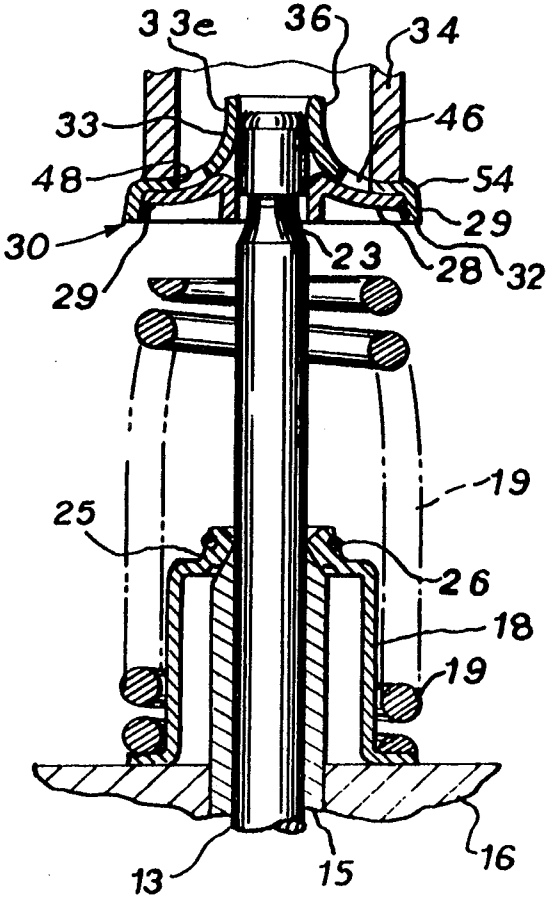

FIGS. 2–4 represent the retainer assembly generally 30 of this invention. It is used with the same components as previously described in the prior art which includes the valve spring 19. The major difference between retainer assemblies 30 and 10 is the fact that the retainer member 36 does not employ keys 21 and thus is of a keyless construction. The retainer member 36 has a central passage 31 which is best seen in FIG. 5 for receiving the valve stem 13. There is a curved arm portion 33 which extends upwardly from the spring retainer portion 32. It has an end portion 33*e* for seating in the groove 23 of the valve stem 13. Connected to the spring retainer portion 32 by the ear like members 29 is a spring support plate 28 which also surrounds the valve stem 13.

Figure 7:
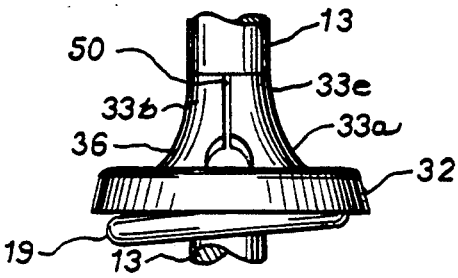
FIG. 7 is a view in side elevation and on a reduced scale showing the valve spring retainer member in an assembled condition.

Referring to FIG. 5, it is seen that the curved arm portion 33 is formed in a unitary manner and has internal grooves 40, 41, 42 and 43. Positioned opposite these grooves are the openings 45, 46, 47 and 48, respectively. These grooves 40–43 are formed so that the arm portion 33 can be broken into four arm discrete segments such as indicated at 33*a* and 33*b* in FIG. 7 for two of them. This is effected by a breakage which will occur from the grooves 40–43 extending in the direction of the openings 45–48 resulting in a break portion 50 for each of the grooves 40–43. The breakage results in four arm segments which not only separate upon expansion but which will come together in a precise rematched manner. In a preferred manner, the grooves 40–43 extend $\frac{2}{3}$ of the wall thickness of the arm portion 33 and have the point of the "V" directed toward the openings 45–48.

An important aspect of the spring retainer member 36 is the curved arm portion 33 which extends upwardly from the spring retainer portion 32 and into the groove 23. The curved arm portion 33 leads into an end portion 33*e* which is orientated in a parallel manner with respect to the groove 23 when it is seated on the valve stem. This curved arm portion 33 and end portion 33*e* allows for the spring retaining portion 32 to be positioned close to the valve stem 13 so as to afford maximum load strength. Yet on the other hand, the curved arm and end portions 33 and 33*e*, respectively, allow for flexibility so that it can be easily loaded or removed from the valve stem. It is easily assembled by the tool 34 engaging the shoulder 54 as shown in FIG. 3 and unassembled such as by the tool 35 with the beveled end 37 as illustrated in FIG. 4. It is at this time that the four arm segments of arm portion 33 expand and contract.

In actual testing of the spring retainer member 36, it has been found that with certain embodiments it requires only 50 pounds of force to assemble and unassemble the retainer, yet it can withstand loads up to 3,400 pounds before breaking when utilizing the support plate 28.

Figure 6:
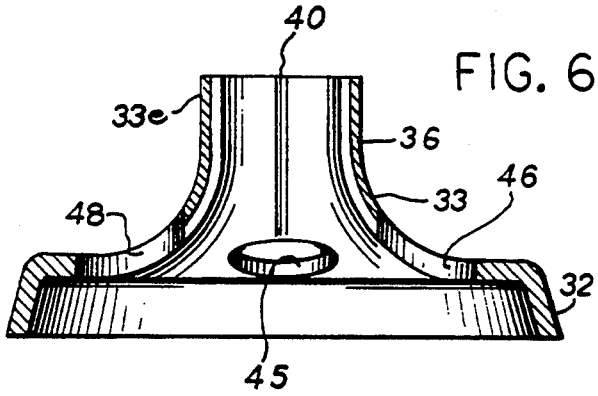
FIG. 6 is a view in vertical section of the valve spring retainer member of FIG. 5.

Referring specifically to FIG. 6, it will be seen that the curved arm portion 33 is in the form of a cone with a curved surface and having a circular cross sectional area larger at the base than at the top. This allows for the previous positioning of the spring and spring retaining portion 32 close to the valve 12, but yet allows for a springing action for ease of loading and removal. In a preferred manner, the retainer member is configured so that the height of the curved arm 33 and the distance of the spring retainer portion 32 away from the valve stem 12 is a 1:1 relationship.

Another important feature of the spring retainer member 36 is the fact that it can allow the valve to rotate while seated in groove 23. This is effected by not having the end portion 33*e* clamp into the stem while seated in the groove 23. Accordingly, when an engine is operated at a high R.P.M., the spring 19 momentarily ceases to exert a force on the valve because the valve spring retainer portion 32 is clamping on itself. Rotation is beneficial for valve life as is well recognized by those skilled in the art. Alternatively the end portion 33*e* can be designed to clamp into the groove 23 of the stem.

Figure 8:
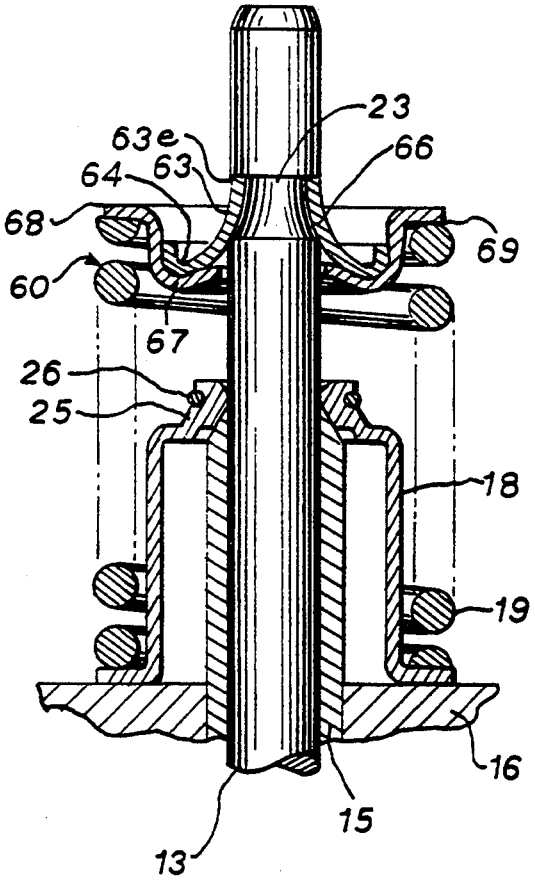
FIGS. 8 and 9 are views similar to FIG. 2 showing alternative embodiments.
Figure 9:
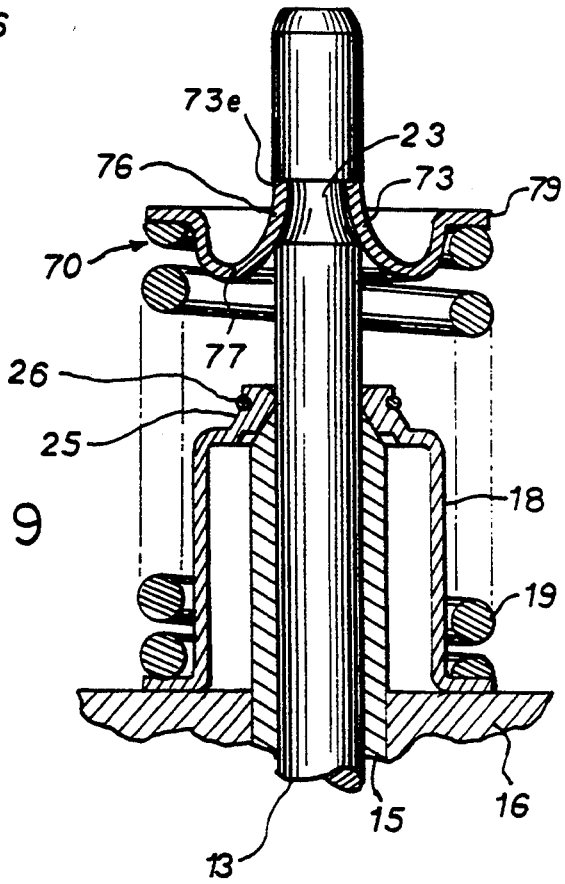

FIGS. 8 and 9 represent alternative embodiments generally 60 and 70 of the retainer assemblies wherein the retainer members 66 and 76 are adapted to fit inside the spring 19. In the instance of retainer member 66, it has the previously described curved arm portion 63 and end portion 63*e* for seating in the annular groove 23 of the valve stem 13. Retainer member 66 is designed for use in conjunction with a reinforcing plate 68 and has a hook or continuous base wall portion 64 for seating in a depressed portion 67 of the reinforcing plate 68 which includes a flange portion 69 for engagement with the spring 19. In all other respects, retainer member 66 is the same as retainer member 36 in having the previously described conical configuration as well as the grooves 40–43 and the openings 45–48 to effect the splitting of the curved arm portion 63 into four segments which is effected prior to the retainer member 66 being connected to the valve stem 13.

Embodiment 70 is similar to 60 except does not utilize a reinforcing plate. It also has a curved arm portion 73 and an end portion 73*e* for seating in groove 23. A depressed portion 77 extends from the curved arm portion 73 terminating in the upward flange portion 79 for engagement with spring 19. It also will have the previously described grooves 40–43 and openings 45–48. Embodiments 60 and 70 afford a low seating of the retainer members 66 and 76 on the valve stem 13 which is an advantage where space considerations are a problem in the engine head. They also are designed to permit the previously described rotation of the valve stem 13 or can be clamped thereon to inhibit rotation depending on the type of placement of end portions 63*e* and 73*e* in groove 23.

The retainer members 36, 66 and 76 are preferably made of spring steel, and the support plates are preferably made of carbon steel. Other metals could be employed such as alloys of titanium as well as byrillium-copper alloys.

The spring retainer member 36 can be used either with or without the support plate 28. However, its load bearing capacity will not be as great without it as it provides 3 to 3.5 times the load bearing support as compared to the retainer member alone. While the support plate 28 is depicted as being connected to the retainer member 36, it can be supplied separately therefrom and later assembled with it. Neither is it necessary that the spring support 18 be present in order to have the advantages of the retainer member 36. The spring could be supported directly on the surface of engine head 16. Further, while four openings 45–48 and grooves 40–43 preferably employed for forming arm segments such as 33*a* and 33*b*, the number of openings and grooves can be varied depending on the type of application desired. Likewise, the configuration of the openings 45–48 can vary depending on stress factors.

It will thus be seen that through the present invention there is now provided a valve spring retainer member which is of a keyless construction. It can be easily assembled and unassembled onto a valve stem. The valve spring retainer member is suitable for use with various sizes and configurations of springs as well as valve stems.

The foregoing invention can now be practiced by those skilled in the art. Such skilled persons will know that the invention is not necessarily restricted to the particular embodiments presented herein. The scope of the invention is to be defined by the terms of the following claims as given meaning by the proceeding description.

I claim:

1. A valve spring retainer assembly of a valve in an internal combustion engine comprising:

a valve stem;

a spring support member surrounding said valve stem;

a spring retainer means connected to said valve stem and spaced from said spring support member, said spring retainer means having a continuous peripheral base wall and an integrally formed curved arm portion, said curved arm portion extending between a spring retaining portion and a connecting portion to said valve stem, said connecting portion being derived only from said curved arm portion, and said connecting portion is aligned substantially parallel with the axis of said valve stem;

a spring member biased between said spring support member and said spring retainer means; and a support plate positioned between said spring member and said continuous base wall of said spring retainer means, wherein said spring retaining portion of said spring retainer means comprises said support plate.

2. The valve spring retainer assembly as defined in claim 1, wherein said curved arm portion is initially formed in a unitary manner but separates into discrete segments prior to being connected to said valve stem.

3. A valve spring retainer means of a valve stem in an internal combustion engine comprising:

a continuous peripheral base wall and an integrally formed curved arm portion, said curved arm portion extending between a spring retaining portion and a connecting portion to said valve stem, said connecting portion being derived only from said curved arm portion and said connecting portion is aligned substantially parallel with the axis of said valve stem, and a support plate providing said spring retaining portion extending within an inner radial periphery of a valve spring.

4. The valve spring retainer assembly as defined in claim 3, wherein said curved arm portion is initially formed in unitary manner but separates into discrete segments prior to being connected to said valve stem.

* * * * *